US009835993B1

(12) United States Patent
Ball et al.

(10) Patent No.: US 9,835,993 B1
(45) Date of Patent: Dec. 5, 2017

(54) METHOD AND SYSTEM FOR CONTROLLING A FUSER OF AN ELECTROPHOTOGRAPHIC IMAGING DEVICE

(71) Applicant: Lexmark International, Inc., Lexington, KY (US)

(72) Inventors: Steve Brennen Ball, Lexington, KY (US); Jichang Cao, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/172,630

(22) Filed: Jun. 3, 2016

(51) Int. Cl.
*G03G 15/20* (2006.01)

(52) U.S. Cl.
CPC ..... *G03G 15/205* (2013.01)

(58) Field of Classification Search
CPC ..... G03G 15/205
See application file for complete search history.

(56) References Cited

U.S. PATENT DOCUMENTS 6,930,293 B2 * 8/2005 Matsuo ..... H05B 6/06 219/664
2007/0193998 A1 * 8/2007 Ichino ..... G03G 15/2039 219/216
2013/0322907 A1 * 12/2013 Namiki ..... G03G 13/20 399/69
2015/0083706 A1 * 3/2015 Campbell ..... G03G 15/2057 219/216
2015/0086231 A1 * 3/2015 Bush ..... G03G 15/2042 399/69
2015/0086232 A1 * 3/2015 Campbell ..... G03G 15/2057 399/70
2016/0018764 A1 * 1/2016 Takagi ..... G03G 15/205 399/70

* cited by examiner

*Primary Examiner* — Rodney Bonnette

(57) ABSTRACT

A system and methods for controlling the fuser heater of an electrophotographic imaging device, including initiating a preheating operation for preheating the fuser heater. Following a temperature of the fuser heater reaching a first predetermined temperature during the preheating operation, heater power is calculated based on a current temperature of the fuser heater and upon a second predetermined temperature. Current line voltage of a power supply line powering the electrophotographic device is also calculated, and a maximum heater power is determined based on the calculated current line voltage. The calculated heater power is then compared with the determined maximum heater power and the fuser heater is powered using the heater power equal to a lesser of the calculated heater power and the determined maximum heater power to heat the fuser heater from the first predetermined temperature to a second predetermined temperature.

20 Claims, 8 Drawing Sheets

METHOD AND SYSTEM FOR CONTROLLING A FUSER OF AN ELECTROPHOTOGRAPHIC IMAGING DEVICE

CROSS REFERENCES TO RELATED APPLICATIONS

1. None.

STATEMENT REGARDING FEDERALLY SPONSORED RESEARCH OR DEVELOPMENT

2. None.

REFERENCE TO SEQUENTIAL LISTING, ETC.

3. None.

BACKGROUND

1. Field of the Disclosure

The present disclosure relates generally to fuser control in an electrophotographic imaging device, and particularly to an apparatus and methods for more effectively and efficiently controlling the fuser assembly of an imaging device with reduced risk of cracking the heater member of the fuser assembly.

2. Description of the Related Art

Alternating current (AC) line voltage and power quality across the world are not always within listed specifications and often vary considerably. This can be due to problems and shortcomings with the corresponding power grid or even with the power distribution inside a building. The line voltage or power quality variation has a substantial impact on the operation of electrophotographic printing devices, and particularly on printing performance because fuser heater power changes dramatically with AC line voltage variation. Fuser heater power variations have been seen to cause a number of problems. For instance, excessive fuser heater power for a belt fuser, from an AC line voltage being too high, increases the likelihood of cracking the fuser heater in the belt fuser. Low fuser heater power, from an AC line voltage being too low, often leads to insufficient fusing of toner to sheets of media because the fuser heater cannot maintain a suitable fusing temperature for acceptable toner fusing. When fusing temperatures cannot be maintained at a sufficiently high temperature during a printing operation, the printing device may be configured to stop printing altogether and issue an error, often leading to a disruption in work by those needing timely printed material.

Significant fuser heater power variation also makes it difficult to predict the amount of time needed for a fuser to be ready for performing fusing during a print operation. Inaccurate prediction of such "fuser ready time" may cause poor toner fusing because media sheets enter into the fuser nip of the fuser assembly too early or arrive too late, oftentimes leading to the imaging device flagging an error and stopping the print job before completion. Further, sizeable power variations make it difficult to achieve relatively tight temperature control of the fuser heater. Sizeable variation in fuser heater temperature during a print operation has been seen to cause a "hot offset" condition in which toner is undesirably transferred to the belt of the fuser assembly when fusing temperatures are too high, resulting in the transferred toner transferring back to the media sheet one belt revolution later. Further, toner that is fused at elevated temperatures, relative to typical fusing temperatures, oftentimes has a dull appearance.

Still further, fusing toner at elevated temperatures can result in media sheets undesirably wrapping around the belt of the fuser assembly instead of exiting therefrom, thereby leading to a media jam condition and a further disruption in printing.

To address the above challenges, some existing imaging devices use the time it takes for a fuser heater to be heated to fusing temperatures to predict the AC line voltage. However, such predictions are often inaccurate due to the fuser heater warm up time being influenced by other factors such as variation of initial fuser heater temperature prior to the fuser heater preheating operation, variation in fuser heater resistance distribution, variation in fuser heater thickness, and variation in the operation of the thermistor which is secured to the fuser heater and the connection between the thermistor and the fuser heater.

SUMMARY

Disclosed is a method for heating a fuser heater of a fuser assembly for an electrophotographic imaging device. The method includes initiating a preheating operation for preheating the fuser heater. Following a temperature of the fuser heater reaching a first predetermined temperature during the preheating operation, the method heats the fuser heating using closed loop feedback control, including calculating heater power based on a current temperature of the fuser heater and upon a second predetermined temperature, which is a target temperature. Current line voltage of a power supply line powering the electrophotographic device is also calculated, and a maximum allowed heater power is determined based on the calculated current line voltage. The calculated heater power is then compared with the determined maximum allowed heater power. The method further includes powering the fuser heater using heater power equal to a lesser of the calculated heater power and the determined maximum allowed heater power to heat the fuser heater from the first predetermined temperature to a second predetermined temperature.

During the preheating operation, a heating rate of the fuser heater is calculated. It is then determined whether the calculated heating rate exceeds a predetermined heating rate threshold and, if the calculated heating rate exceeds the heating rate threshold, heater power is reduced.

According to an example embodiment, the preheating operation described above is utilized when heating the fuser heater from a standby temperature (corresponding to the first predetermined temperature) to the fusing temperature for performing a fusing operation (corresponding to the predetermined second temperature). Prior to the temperature of the fuser heater reaching the standby temperature, the preheating operation includes heating the fuser heater using open-loop power control, including measuring a warm-up time for the fuser heater, comparing the measured warm-up time to a predetermined warm-up time threshold, and if the measured warm-up time is shorter than the predetermined warm-up time threshold, cutting off power to the fuser heater. By ensuring that the fuser heating does not warm up too fast, cracking of the fuser heater is better avoided.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
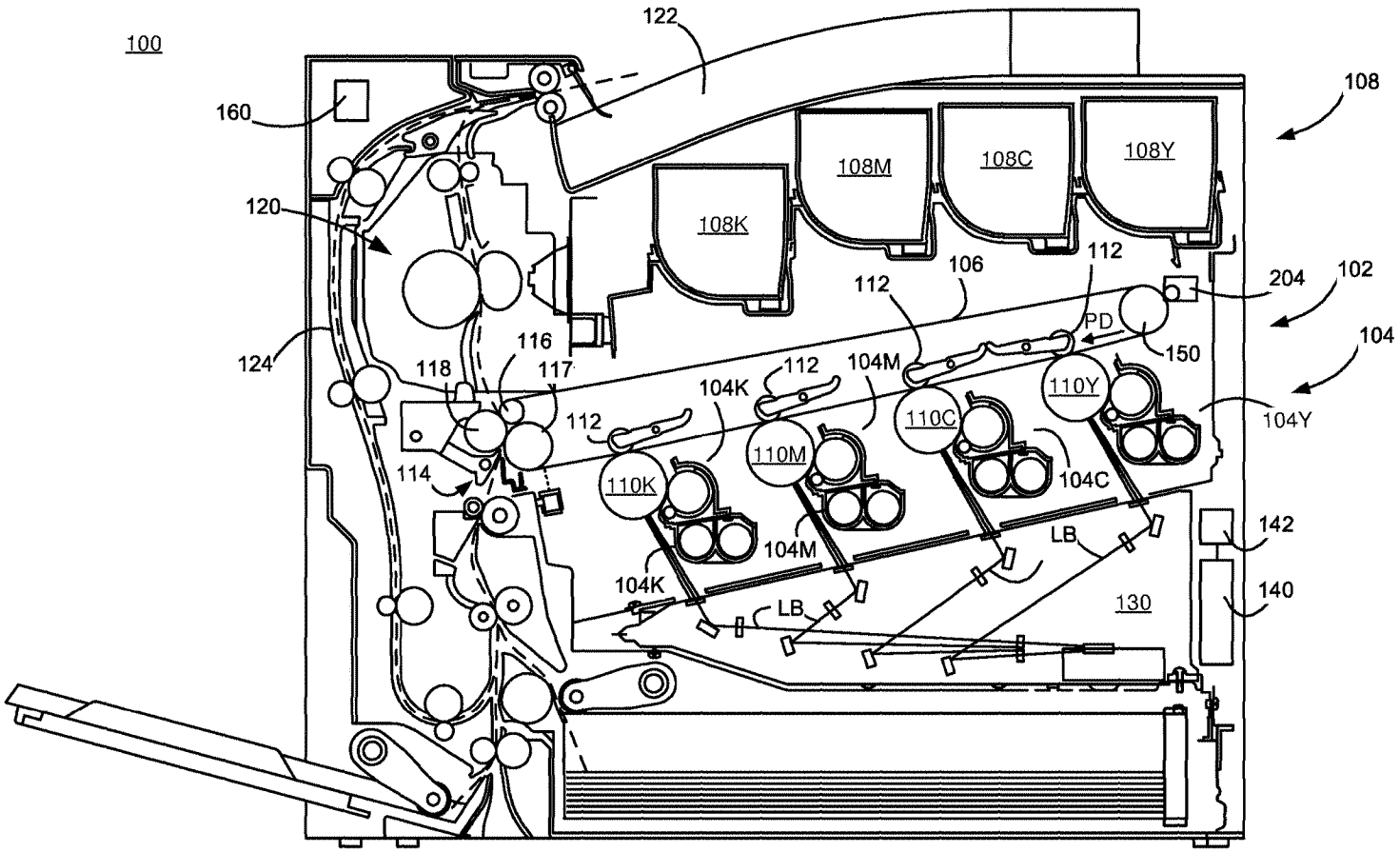
FIG. 1 is a side elevational view of an imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color imaging device 100 according to an example embodiment. Imaging device 100 includes a first toner transfer area 102 having four developer units 104Y, 104C, 104M and 104K that substantially extend from one end of imaging device 100 to an opposed end thereof. Developer units 104 are disposed along an intermediate transfer member (ITM) 106. Each developer unit 104 holds a different color toner. The developer units 104 may be aligned in order relative to a process direction PD of the ITM belt 106, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in a printing operation. Each toner reservoir 108Y, 108C, 108M and 108K is controlled to supply toner as needed to its corresponding developer unit 104. Each developer unit 104 is associated with a photoconductive member 110Y, 110C, 110M and 110K that receives toner therefrom during toner development in order to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM belt 106 is disposed adjacent to each of developer unit 104. In this embodiment, ITM belt 106 is formed as an endless belt disposed about a backup roll 116, a drive roll 117 and a tension roll 150. During image forming or imaging operations, ITM belt 106 moves past photoconductive members 110 in process direction PD as viewed in FIG. 1. One or more of photoconductive members 110 applies its toner image in its respective color to ITM belt 106. For monocolor images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM belt 106.

ITM belt 106 rotates and collects the one or more toner images from the one or more photoconductive members 110 and then conveys the one or more toner images to a media sheet at a second transfer area 114. Second transfer area 114 includes a second transfer nip formed between back-up roll 116, drive roll 117 and a second transfer roller 118. Tension roll 150 is disposed at an opposite end of ITM belt 106 and provides suitable tension thereto.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Imaging device 100 is depicted in FIG. 1 as a color laser printer in which toner is transferred to a media sheet in a two-step operation. Alternatively, imaging device 100 may be a color laser printer in which toner is transferred to a media sheet in a single-step process—from photoconductive members 110 directly to a media sheet. In another alternative embodiment, imaging device 100 may be a monochrome laser printer which utilizes only a single developer unit 104 and photoconductive member 110 for depositing black toner directly to media sheets. Further, imaging device 100 may be part of a multi-function product having, among other things, an image scanner for scanning printed sheets.

Imaging device 100 further includes a controller 140 and memory 142 communicatively coupled thereto. Though not shown in FIG. 1, controller 140 may be coupled to components and modules in imaging device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling imaging device 100 to perform, among other functions, printing operations.

Still further, imaging device 100 includes a power supply 160. In the example embodiment, power supply 160 is a low voltage power supply which provides power to many of the components and modules of imaging device 100. Imaging device 100 may further include a high voltage power supply (not shown) for provide a high supply voltage to modules and components requiring higher voltages.

Figure 2:
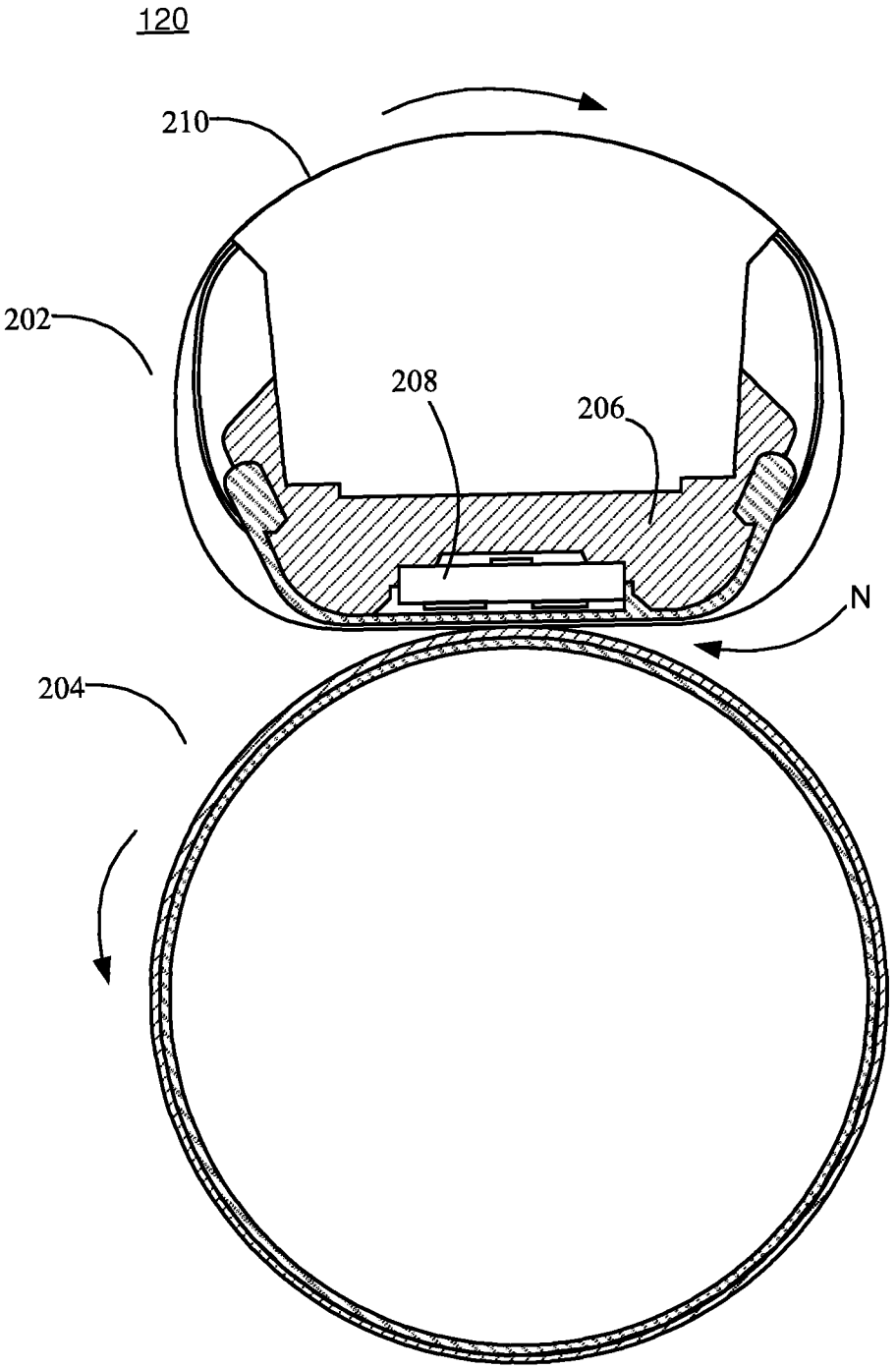
FIG. 2 is a side view of a fuser assembly of FIG. 1, according to an example embodiment.

With respect to FIG. 2, in accordance with an example embodiment, there is shown fuser assembly 120 for use in fusing toner to sheets of media through application of heat and pressure. Fuser assembly 120 may include a heat transfer member 202 and a backup roll 204 cooperating with the heat transfer member 202 to define a fuser nip N for conveying media sheets therein. The heat transfer member 202 may include a housing 206, a heater member 208 supported on or at least partially in housing 206, and an endless flexible fuser belt 210 positioned about housing 206. Heater member 208 may be formed from a substrate of ceramic or like material to which at least one resistive trace is secured which generates heat when a current is passed through it. Heater member 208 may be constructed from the elements and in the manner as disclosed in U.S. patent application Ser. No. 14/866,278, filed Sep. 25, 2015, and assigned to the assignee of the present application, the content of which is incorporated by reference herein in its entirety. The inner surface of fuser belt 210 contacts the outer surface of heater member 208 so that heat generated by heater member 208 heats fuser belt 210.

Fuser belt 210 is disposed around housing 206 and heater member 208. Backup roll 204 contacts fuser belt 210 such that fuser belt 210 rotates about housing 206 and heater member 208 in response to backup roll 204 rotating. With fuser belt 210 rotating around housing 206 and heater member 208, the inner surface of fuser belt 210 contacts heater member 208 so as to heat fuser belt 210 to a temperature sufficient to perform a fusing operation to fuse toner to sheets of media.

Fuser belt 210 and backup roll 204 may be constructed from the elements and in the manner as disclosed in U.S. Pat. No. 7,235,761, which is assigned to the assignee of the present application and the content of which is incorporated by reference herein in its entirety. It is understood, though, that fuser assembly 120 may have a different fuser belt architecture or even a different architecture from a fuser belt based architecture.

Figure 3:
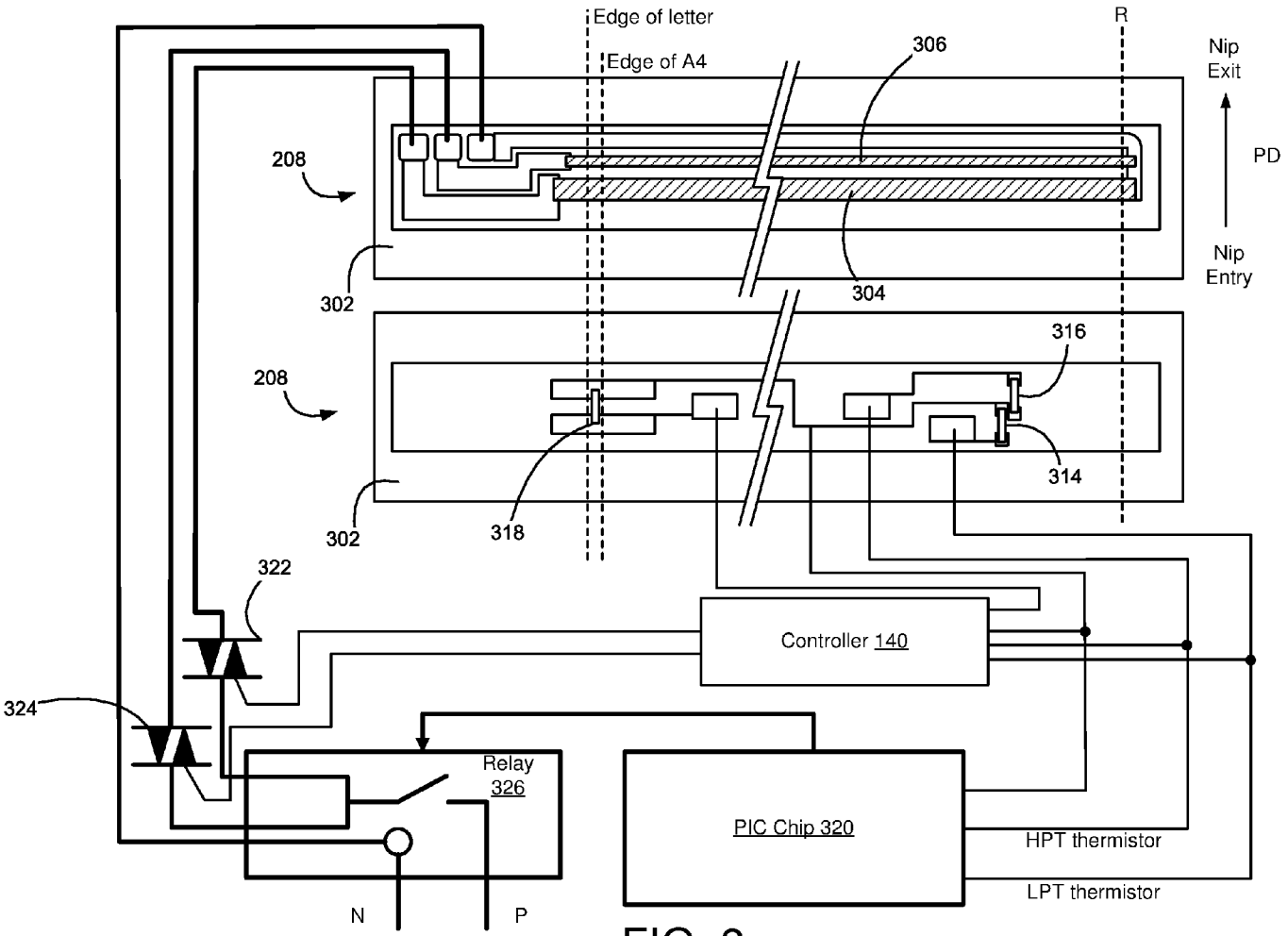
FIG. 3 shows a control circuit for a heater member of the fuser assembly of FIG. 2, according to an example embodiment.

FIG. 3 shows heater member 208 and the control circuitry therefor according to an example embodiment. In this embodiment, imaging device 100 includes a reference-edge based media feed system in which the media sheets are aligned in the media feed path of imaging device 100 using a side edge of each sheet. Heater member 208 includes a substrate 302 constructed from ceramic or other like material. Disposed on a bottom surface of substrate 302 in parallel relation with each other are two resistive traces 304 and 306. Resistive trace 304 is disposed on the entry side of fuser nip N and resistive trace 306 is disposed on the exit side of fuser nip N so that the process direction PD of fuser assembly 120 is illustrated in FIG. 3.

The length of resistive trace 304 is comparable to the width of a Letter sized sheet of media and is disposed on substrate 302 for fusing toner to letter sized sheets. The length of resistive trace 306 is comparable to the width of A4 sized sheet of media and is disposed on substrate 302 for fusing toner to A4 sized sheets. In an example embodiment, the width of resistive trace 304 is larger than the width of resistive trace 306 in order to have different heating zone requirements for different print speeds. In an example embodiment, the width of resistive trace 304 is between about 4.5 mm and about 5.5 mm, such as 5 mm, and the width of resistive trace 306 is between about 2.0 mm and about 2.50 mm, such as 2.25 mm. In general terms, the width of resistive trace 304 is between about two and about three times the width of resistive trace 306. By having such a difference in trace widths, and with the resistivity of resistive trace 304 being substantially the same as the resistivity of resistive trace 304 such that the resistance of trace 304 is less than the resistance of trace 306, resistive trace 304 may be used for lower printing speeds and both resistive traces 304 and 306 may be used for relatively high printing speeds.

In an example embodiment, resistive traces 304, 306 have different power levels. In an example embodiment, resistive trace 304, hereinafter referred to as high power trace 304, has a power level of about 1000 W and resistive trace 306, hereinafter referred to as low power trace 306, has a power level of about 500 W. A plurality of thermistors is disposed on a top surface of substrate 302. Thermistor 314 is disposed on the top surface of substrate 302 opposite an area of resistive trace 306 near the length-wise end of resistive trace 304 that corresponds to the reference edge R of a sheet of media passing through fuser nip N. Similarly, thermistor 316 is disposed on the top surface of substrate 302 opposite resistive trace 306 near the length-wise end of resistive trace 304 that corresponds to the reference edge R of the sheet of media. A third thermistor, thermistor 318, is disposed on the top surface of substrate 302 opposite an area of heater member 208 that does not contact A4 media but contacts Letter sized media. In FIG. 3, thermistors 314, 316 and 318 include wires for communicating the temperature-related electrical signals generated thereby to controller 140 and PIC chip 320. By having thermistors disposed on substrate 302 in this way, resistive traces 304, 306 may be independently controlled so that heater member 208 achieves a more uniform temperature profile from nip entry to nip exit of fuser nip N.

Further, resistive traces 304, 306 are connected to TRIACs 322 and 324, respectively, and then to relay 326. Specifically, the end of resistive traces 304 and 306 corresponding to reference edge R is connected to terminal N via relay 326, and the opposite ends of resistive traces 304 and 306 are connected to an anode of TRIACs 322 and 324, respectively. The second anode of TRIACs 322 and 324 are connected to each other and to relay 326. Terminal P is coupled to relay 326. Controller 140 is coupled to the gate of TRIACs 322 and 324 for activating same. The programmable interface controller (PIC) chip 320 independently controls relay 326 and opens relay 326 in the event of excessive heating of resistive traces 304, 306.

Figure 4:
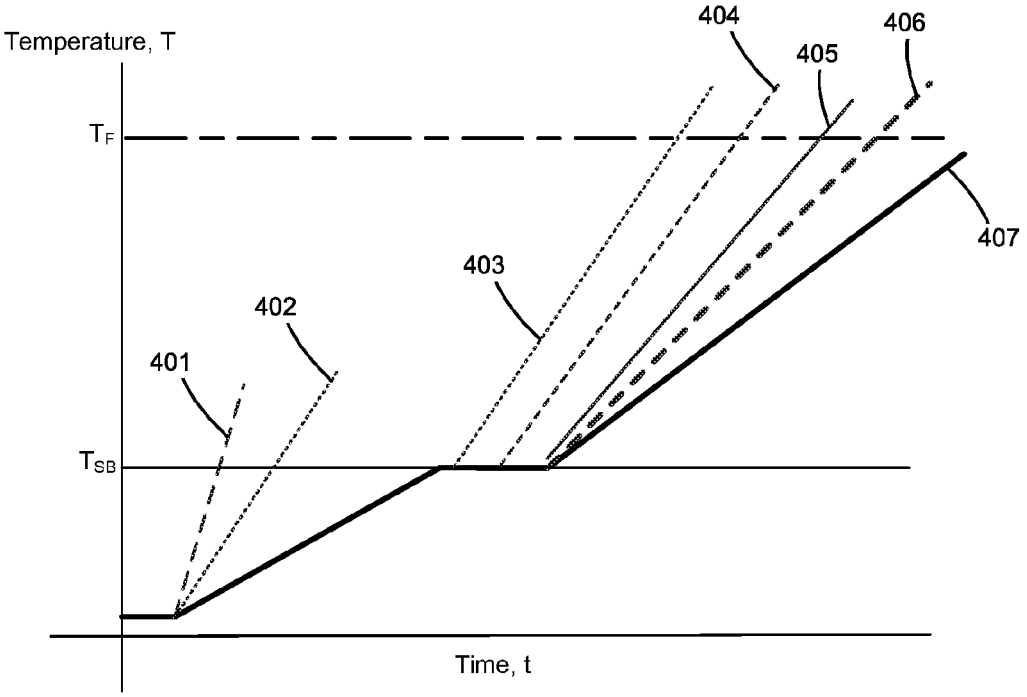
FIG. 4 illustrates temperature profiles illustrating a number of different heating situations when heating the heater member of the fuser assembly of FIG. 2 during a preheating operation.

FIG. 4 shows heating rate profiles for a number of situations when cracking of heater member 208 may occur. Heater cracking may occur, for example, when the wrong fuser assembly 120 is inserted into imaging device 100. For example, if a 115V fuser assembly is used in a 230V imaging device 100, heater power may increase to four times the normal level, from 1500 W at 115V to 6000 W at 230V. Under such excessive heating conditions, the heating rate may be represented by line 401 and heater member 208 will crack almost immediately after imaging device 100 is turned on.

Heater member 208 may also crack due to various hardware failures. For example, lines 402 and 403 illustrate heating rates when either or both of TRIACs 322, 324 is shorted during preheating heater member 208 from room temperature to a standby temperature $T_{SB}$, and from the standby temperature $T_{SB}$ to a fusing temperature $T_F$, respectively. In such situations, heater member 208 is heated with maximum heating power, causing heater member 208 to crack unless PIC chip 320 is able to quickly turn off power. Heater member 208 could also crack if fuser belt 210 stalls, backup roll 204 fails to rotate due to a broken gear driving backup roll 204 or fuser nip N fails to close during fuser heating. In such situations, heat cannot be quickly removed from heater member 208 by fuser belt 210 and backup roll 204, causing the temperature to increase rapidly, as illustrated by line 404. The thermal gradient across heater member 208 combined with compression stress could cause heater member 208 to crack.

Heating rate of heater member 208 depends not only on power, but also on backup roll 204 temperature and ambient environment conditions. In some environments, the heating rate of heater member 208, illustrated as line 405, during preheating of heater member 208 from the standby temperature $T_{SB}$ to a fusing temperature $T_F$ can relatively easily increase above a predetermined limit, such as about 80° C. per second, corresponding to line 406. In some cases, the heating rate could get above 100° C. per second. Excessive heating rates as illustrated, relative to line 406 corresponding to the predetermined heating rate limit, may cause heater crack during a fusing operation. The desired heating rate to prevent heater member 208 from cracking would be as illustrated by line 407.

Figure 5:
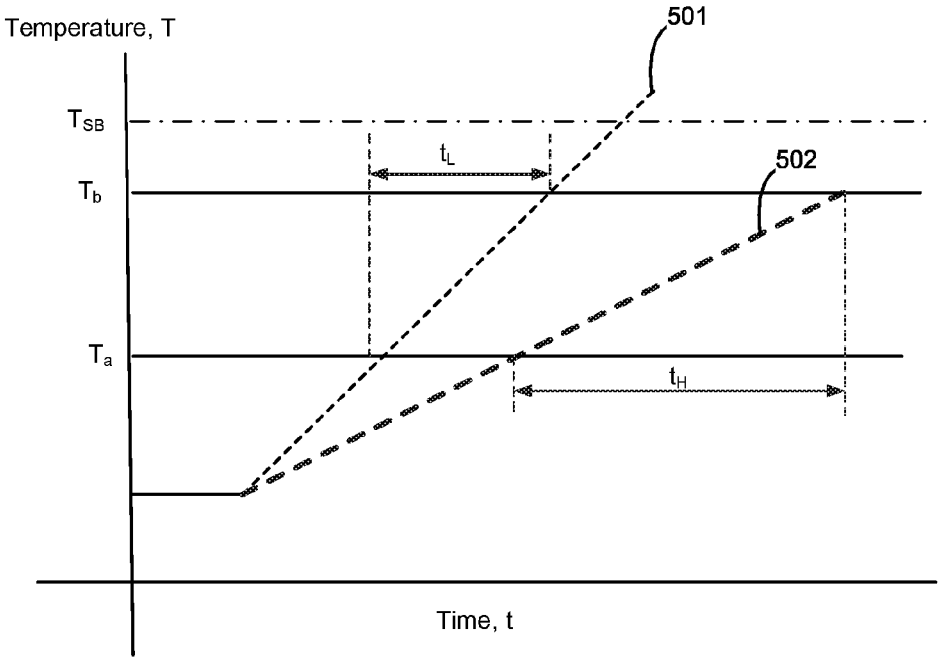
FIG. 5 illustrates a method of heating resistive traces of the heater member of the fuser assembly of FIG. 2 during a preheating operation, according to an example embodiment.

FIG. 5 shows the heating rate profiles of resistive traces 304 and 306 during a preheating operation to heat heater member 208 to the standby temperature $T_{SB}$. In FIG. 5, line 501 shows the temperature of low power trace 306 and line 502 shows the temperature of high power trace 304 during the preheating operation. For discussion purposes, FIG. 5 will be described in conjunction with the description of method 600 of FIG. 6.

Figure 6:
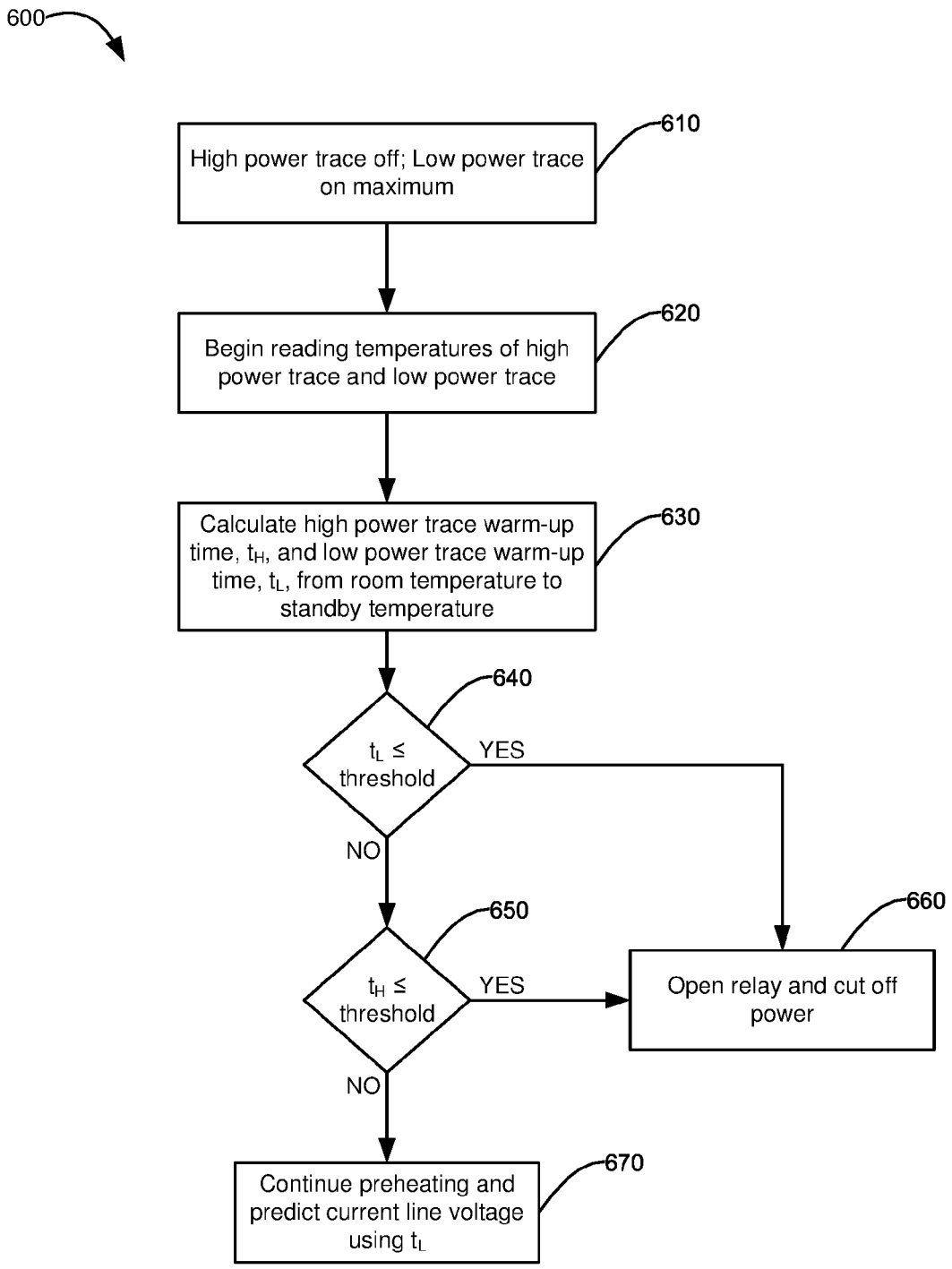
FIG. 6 shows a method for heating the heater member of the fuser assembly of FIG. 2 to a standby temperature using open-loop power control according to an example embodiment.

FIG. 6 shows and example method 600 for detecting, in this case, a wrong fuser condition and/or a shorted TRIAC condition described above.

When a preheating operation is initialized to heat heating member 208 to the standby temperature $T_{SB}$, high power trace 304 is unpowered and low power trace 306 is activated at or near maximum power at block 610. At block 620, the temperatures of high power trace 304 from thermistor 316 and low power trace 306 from thermistor 314 are read by PIC chip 320 and the times of such readings are recorded by PIC chip 320. Based on the temperatures indicated by the thermistors, PIC chip 320 calculates the warm-up time $t_h$ of high power trace 304 and the warm-up time $t_l$ of low power trace 306 at block 630. The high power trace warm-up time $t_h$ and the low power trace warm-up time $t_l$ are each calculated from a time for the corresponding trace to be heated from a first temperature $T_a$ to a second temperature $T_b$, as shown in FIG. 5. In an example embodiment, $T_a$ and $T_b$ are the room temperature and the standby temperature $T_{SB}$, respectively.

At block 640, PIC chip 320 determines whether the low power trace warm-up time $t_l$ is shorter than a first predetermined warm-up time threshold saved in memory in PIC chip 320. At block 650, PIC chip 320 determines whether the high power trace warm-up time $t_h$ is shorter than a second predetermined warm-up time threshold saved in PIC chip 320. In some example embodiments, the first predetermined warm-up time is different from the second predetermined warm-up time. In other example embodiments, the first and second predetermined warm-up times have the same value. Upon a positive determination, at either block 640 or block 650, indicating that heater member 208 is heating up too fast, PIC chip 320 opens relay 326 and thus cuts off power to heater member 208 at block 660. After PIC chip 320 cuts off power to heater member 208, controller 140 may also display an error message on a user interface of imaging device 100, informing a user of an error condition. In this way, imaging device 100 prevents heater member 208 from being heated too fast, thereby lessening the likelihood of heater member 208 cracking.

Upon a negative determination at both blocks 640 and 650, controller 140 continues to heat heater member 208 to the standby temperature $T_{SB}$ and uses low power trace warm-up time $t_l$ to calculate the line voltage provided to imaging device 100 at block 670. In an example embodiment, controller 140 predicts the line voltage using the technique disclosed in U.S. patent application Ser. No. 15/009,261, filed Apr. 16, 2016, and assigned to the assignee of the present application, the content of which is incorporated by reference herein in its entirety. Following the estimation of the line voltage, controller 140 is able to calculate the fuser ready time and print speed based in part upon the calculated fuser ready time.

Whereas the heating of heater member 208 utilizes open loop control when heating heater member 208 to the predetermined standby temperature $T_{SB}$, imaging device 100 utilizes closed loop control when heating heater member 208 from the standby temperature $T_{SB}$ to a fusing temperature $T_F$ suitable for performing a fusing operation.

Figure 7:
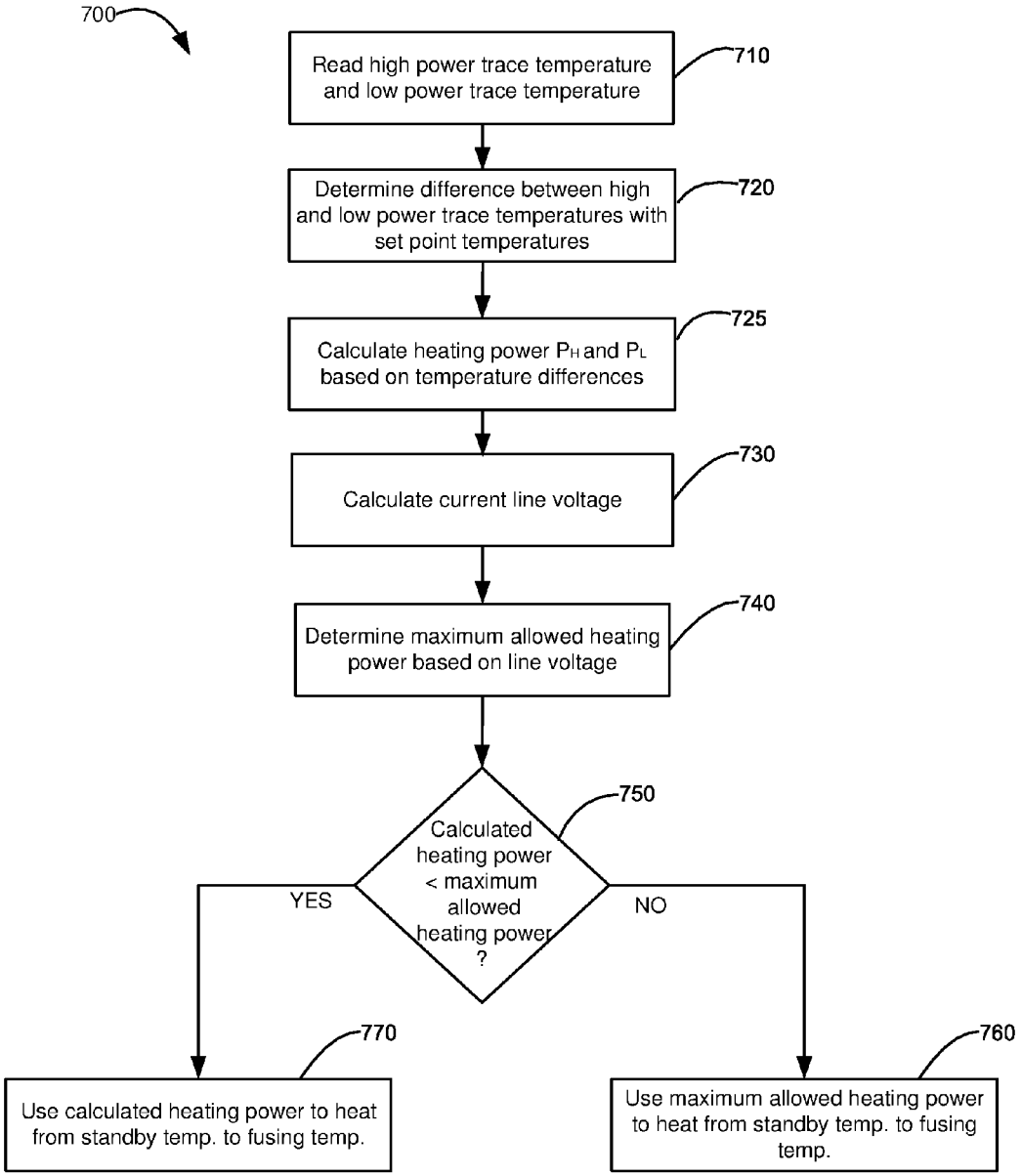
FIGS. 7 and 8 depict methods for heating the heater member of the fuser assembly of FIG. 2 to a fusing temperature according to an example embodiment.

FIG. 7 shows an example method of heating heater member 208 from the standby temperature $T_{SB}$ to a fusing temperature $T_F$ while lessening the chances of heater member 208 heating too quickly and cracking as a result. During a preheating operation for heating heater member 208 from the standby temperature $T_{SB}$ to a fusing temperature $T_F$ for performing a fusing operation, a heater set point or target temperature for each of high power trace 304 and low power trace 306 is provided to or by controller 140. The temperatures of high power trace 304 and low power trace 306 are measured by controller 140 at 710. The temperature difference $\Delta T_L$ and $\Delta T_H$ between the set point temperature and the corresponding measured temperature is determined by controller 140 at 720 for each of high power trace 304 and low power trace 306, respectively. Using the determined temperature differences $\Delta T_H$ and $\Delta T_L$, heater power $P_H$ and $P_L$, respectively, are calculated by controller 140 at 725. The calculations for heater power $P_H$ and $P_L$ may also be based upon the estimated line voltage from block 670 in FIG. 6. At block 740, controller 140 determines the maximum allowed power levels $P_{Hmax}$ and $P_{Lmax}$ for high power trace 304 and low power trace 306, respectively.

The calculation of the maximum allowed power $P_{Hmax}$ and $P_{Lmax}$ for traces 304 and 306, respectively, is based upon the current line voltage used to power imaging device 100 that was calculated in block 670 of FIG. 6. When the current line voltage is lower than 110V for a low-voltage fuser assembly 120 (or 220V for a high-voltage fuser assembly 120), the maximum allowed power $P_{Hmax}$ and $P_{Lmax}$ is the same as the maximum or total heating is power for heating heater member 208. When the voltage is above 110V, however, a percentage less than the maximum heater power is allowed to power traces 304 and 306 of heater member 208. In an example embodiment, a table is maintained in memory 142 that is accessed by controller 140. The table lists, for each of a number of different line voltage levels, the maximum allowed power to power heater member 208, which in the example embodiment is generally around 1300 W. The table also includes, for each line voltage level listed, the total or maximum power at the corresponding line voltage for each trace 304 and 306, including the sum thereof which is the total power for heater member 208. The table further includes a percentage of the maximum power allowed to the total power for heater member 208, which is expressed as a maximum percentage power allowed $P_{PA}$ during the preheating operation. The table is depicted below as Table 1, according to an example embodiment.

TABLE 1

| Line Voltage (V) | HPT Power (W) | LPT Power (W) | Total Power (W) | Max Percent Power Allowed $P_{PA}$ during Preheating (%) | Max Power Allowed during Preheating (W) |
|---|---|---|---|---|---|
| 145/290 | 1589.79 | 715.41 | 2305.2 | 56 | 1290.91 |
| 143/286 | 1546.24 | 695.81 | 2242.05 | 58 | 1300.39 |
| 141/282 | 1503.29 | 676.48 | 2179.77 | 60 | 1307.86 |
| 139/278 | 1460.95 | 657.43 | 2118.37 | 62 | 1313.39 |
| 137/274 | 1419.21 | 638.64 | 2057.85 | 64 | 1317.02 |
| 135/270 | 1378.07 | 620.13 | 1998.2 | 66 | 1318.81 |
| 133/266 | 1337.54 | 601.89 | 1939.44 | 68 | 1318.82 |
| 131/262 | 1297.62 | 583.93 | 1881.55 | 70 | 1317.08 |
| 129/258 | 1258.3 | 566.23 | 1824.53 | 72 | 1313.66 |
| 127/254 | 1219.58 | 548.81 | 1768.4 | 74 | 1308.61 |
| 125/250 | 1181.47 | 531.66 | 1713.14 | 76 | 1301.98 |
| 123/246 | 1143.97 | 514.79 | 1658.76 | 78 | 1293.83 |
| 121/242 | 1107.07 | 498.18 | 1605.25 | 82 | 1316.31 |
| 119/238 | 1070.78 | 481.85 | 1552.62 | 84 | 1304.2 |
| 117/234 | 1035.09 | 465.79 | 1500.87 | 88 | 1320.77 |
| 115/230 | 1000 | 450 | 1450 | 90 | 1305 |
| 113/226 | 965.52 | 434.48 | 1400 | 94 | 1316 |
| 111/222 | 931.64 | 419.24 | 1350.88 | 96 | 1296.85 |
| 109/219 | 898.37 | 404.27 | 1302.64 | 100 | 1302.64 |
| 107/214 | 865.71 | 389.57 | 1255.28 | 100 | 1255.28 |
| 105/210 | 833.65 | 375.14 | 1208.79 | 100 | 1208.79 |
| 103/206 | 802.19 | 360.99 | 1163.18 | 100 | 1163.18 |
| 101/202 | 771.34 | 347.1 | 1118.45 | 100 | 1118.45 |
| 99/198 | 741.1 | 333.49 | 1074.59 | 100 | 1074.59 |
| 97/194 | 711.46 | 320.16 | 1031.61 | 100 | 1031.61 |
| 95/190 | 682.42 | 307.09 | 989.51 | 100 | 989.51 |
| 93/186 | 653.99 | 294.29 | 948.28 | 100 | 948.28 |
| 91/182 | 626.16 | 281.77 | 907.94 | 100 | 907.94 |
| 89/178 | 598.94 | 269.52 | 868.47 | 100 | 868.47 |

TABLE 1-continued

| Line Voltage (V) | HPT Power (W) | LPT Power (W) | Total Power (W) | Max Percent Power Allowed $P_{PA}$ during Preheating (%) | Max Power Allowed during Preheating (W) |
|---|---|---|---|---|---|
| 87/174 | 572.33 | 257.55 | 829.87 | 100 | 829.87 |
| 85/170 | 546.31 | 245.84 | 792.16 | 100 | 792.16 |

The determination of the maximum allowed power levels $P_{Hmax}$ and $P_{Lmax}$ for high power trace 304 and low power trace 306, respectively, will be explained. The maximum allowed power level $P_{Hmax}$ is calculated by selecting the maximum percentage power allowed $P_{PA}$ for heater member 208 corresponding to the previously-calculated line voltage and multiplying the percentage value by the total power for trace 304 at the calculated line voltage. For example, at a calculated line voltage of 145 V, the maximum percentage power allowed $P_{PA}$ is 56% and the total power for high power trace 304 is 1589.79 W, so the product of the percentage and the total power, which is the maximum allowed power level $P_{Hmax}$ for trace 304, is 890.28 W. For the maximum allowed power level $P_{Lmax}$ for low power trace 306 at the same line voltage of 145 V, the maximum percentage power allowed $P_{PA}$ remains 56% and the total power for low power trace 306 is 715.41 W, resulting in the product of the percentage and total power (maximum allowed power level being $P_{Lmax}$) 400.62 W.

At block 750, controller 140 compares, for each trace 304, 306 of heater member 208, the calculated heating power ($P_H$, $P_L$) from block 725 with the corresponding maximum allowed heating power ($P_{Hmax}$, $P_{Lmax}$) determined at block 740. If the calculated heating power ($P_H$, $P_L$) for either trace is higher than the corresponding maximum allowed heating power ($P_{Hmax}$, $P_{Lmax}$) therefor at the current line voltage, controller 140 caps the power for heating such trace at the corresponding maximum allowed heating power ($P_{Hmax}$, $P_{Lmax}$) at block 760. If the calculated heating power ($P_H$, $P_L$) for a trace 304, 306 is less than the corresponding maximum allowed heating power ($P_{Hmax}$, $P_{Lmax}$) the calculated heating power ($P_H$, $P_L$) for such trace will be used for heating the trace at block 770.

In another example embodiment, blocks 740 and 750 are performed relative to heater member 208 as a whole. Specifically, at block 740 controller 140 determines the maximum allowed heating power $P_{MA}$ for heater member 208. This determination is performed by identifying the total power for heater member 208 from Table 1 at the previously-calculated line voltage, and multiplying the total power by the corresponding maximum percentage power allowed $P_{PA}$. For example, at a line voltage of 145 V, total power for heater member 208 is 2305.2 W (from Table 1) and the maximum percentage power allowed $P_{PA}$ is 56%. The product of 2305.2 W and 56% is 1290.12 W, which is the maximum allowed power $P_{MA}$ for heater member 208 during the preheating operation. In block 750, then, the total heater power $P_T$, which is the sum of heater power $P_H$ and $P_L$ calculated in block 725, is compared with the maximum allowed power $P_{MA}$ for heater 208 (1290.12 W, in this example). If the total heater power $P_T$ is greater than the maximum allowed power $P_{MA}$ for heater member 208, then the power applied to heater member 208 for the preheating operation is capped at the maximum allowed power $P_{MA}$ for heater member 208. In capping the power applied to heater member 208 in this way, the power applied to traces 304, 306 may be shared proportionately or via some other scheme.

By powering heater member 208 during a preheating operation, heater member 208 is heated in a controlled manner to ensure that heater member 208 is not powered at a heightened power level which may cause heater member 208 to crack. Even controlled heating power applied to heater member 208 during the preheating operation from the standby temperature $T_{SB}$ to the fusing temperature $T_F$, the heating rate may potentially reach an undesirable level due to various conditions, such as the initial temperature of heater member 208 and backup roll 204, ambient temperature and humidity, the timing associated with closing fuser nip N, and the rotational speed of fuser belt 210. In some conditions, the heating rate for heater member 208 may possibly exceed 120° C. per second, which will trigger PIC chip 320 to open the relay and cause imaging device 100 to suspend printing and issue an excessive heating rate error.

To prevent the suspension of printing and the issuance of an error, a method is developed to further reduce heating power when a high heating rate is detected.

Figure 8:
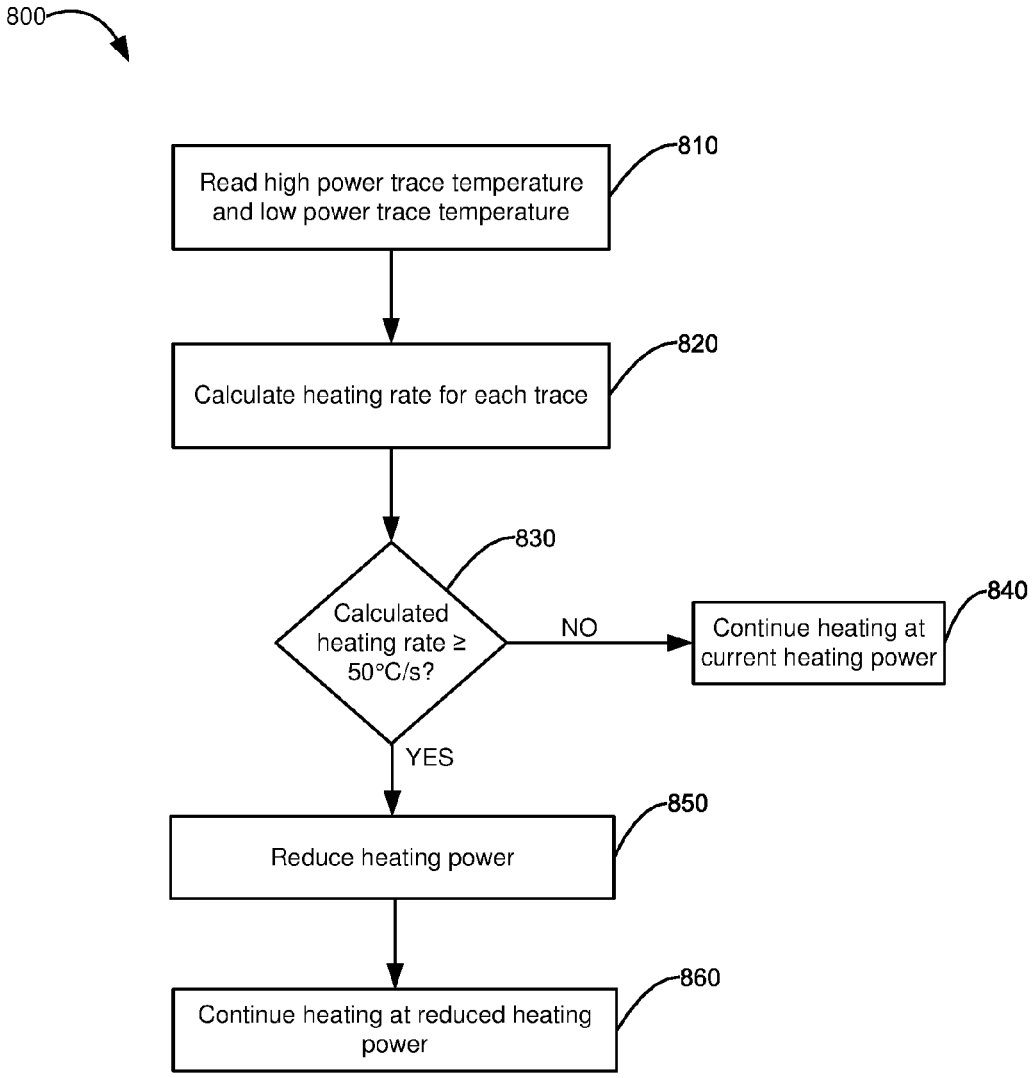

FIG. 8 shows an example method 800 of controlling heating power based on heating rate during the preheating operation when heating heater member 208 from the standby temperature $T_{SB}$ to a fusing temperature $T_F$, according to an example embodiment. At block 810, the temperatures of high power trace 304 and low power trace 306 are measured at predetermined intervals during the preheating operation using thermistors 316 and 314, respectively. Based on the temperature measurements, heating rate is calculated by controller 140 at the predetermined intervals at block 820 for each trace 304, 306. In some example embodiments, the heating rate is calculated every 30 msec. At block 830, the calculated heating rate for each trace 304, 306 is compared with a heating rate threshold stored in memory 142. In one example embodiment, the heating rate threshold is between about 40° C. per second and about 60° C. per second, such as 50° C. per second.

If it is determined by controller 140 at block 830 that the calculated heating rate is less than the heating rate threshold, the preheating operation is continued at block 840 using the current heating power. If it is determined by controller 140 at block 830 that the calculated heating rate is equal to or exceeds the heating rate threshold, the heating power is reduced at block 850 before the preheating operation continues at block 860. In some example embodiments, the heating power is reduced in block 850 from its current heating power level using a step power reduction algorithm, according to equation E1:

$$\text{Reduced heating power} = \text{current heating power} * \text{PowerScale}$$

where the PowerScale is a constant value between about 0.1 and about 0.5, such as about 0.3. In other example embodiments, the heating power is reduced from the measured heating rate using a proportional power reduction algorithm, according to equation E2:

$$\text{Reduced heating power} = \text{current heating power} - k * (\text{measured heating rate} - \text{heating rate threshold})$$

where, k is a constant value between about 1 and about 5 and "heating rate threshold" is the threshold described above.

Figure 9:
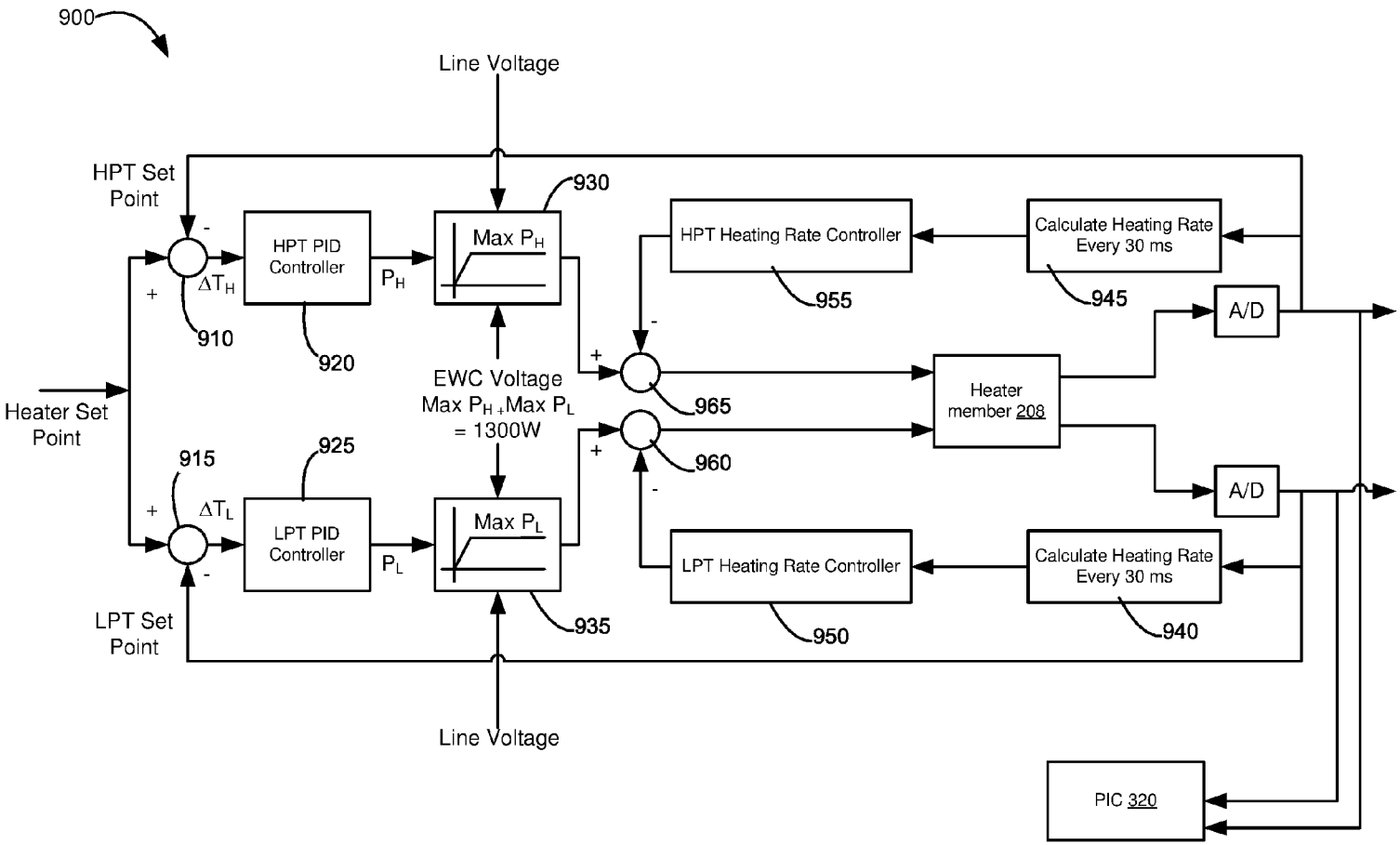
FIG. 9 is a block diagram of an example closed loop control system for use in controlling the heating of the heater member of the fuser assembly of FIG. 2 utilizing the methods of FIGS. 7 and 8.

With reference to FIG. 9, a control block diagram is shown of a closed loop control system 900, formed by heater member 208 and the control circuitry of FIG. 3, for controlling the preheating of heater member 208 as described above. Closed-loop control system 900 is configured to prevent heater member 208 from heating too quickly by controlling maximum heating power using a method such as example method 700 (FIG. 7), and to further reduce heating power when a high heating rate is detected, using a method such as example method 800 (FIG. 8). In this example embodiment, controller 140 may be viewed as a proportional integral derivative (PID) controller. For example, when using closed-loop control system 900 to execute example method 700 during a preheating operation, a heater set point or target temperature, which may be provided by controller 140, is input into nodes 910 and 915. Temperature readings from thermistors 314 and 316 are fed back into nodes 910 and 915, respectively. Nodes 910 and 915 generate temperature differences $\Delta T_H$ and $\Delta T_L$ between the current temperatures of high power trace 304 and low power trace 306, respectively, and their corresponding heater set point temperatures. The temperature differences $\Delta T_H$ and $\Delta T_L$ are then input into PID controller blocks 920 and 925, respectively, which calculate the heater power levels $P_H$ and $P_L$ discussed above with respect to block 725 of FIG. 7. The output of PID controller blocks 920 and 925 is heating power $P_L$ for low power trace 306 and heating power $P_H$ for high power trace 304, respectively. Heating power $P_L$ and heating power $P_H$ are then used to determine the total heating power at blocks 930 and 935, as described above with respect to blocks 750-770 in FIG. 7.

With continued reference to FIG. 9, the digitized output of each thermistor 314 and 316 is used by blocks 940 and 945, respectively, to calculate the heating rate of the trace, as described above with respect to block 820 of FIG. 8. Heating rate control blocks 950 and 955 compare the calculated heating rate of blocks 940 and 945, respectively, with the heating rate threshold and determine whether heating power needs to be reduced due to a heating rate being too high, as discussed above with respect to block 830 of FIG. 8. Upon an affirmative determination that a heating rate is too high, one or both heating rate control blocks 950 and 955 provides a power level as feedback to one or both of node 960 and 965, respectively, using one of equation E1 and equation E2, which effectively reduces power applied to heater member 208 so as to substantially reduce the occurrence of heater member 208 cracking.

The description of the details of the example embodiments have been described in the context of a color electrophotographic imaging devices. However, it will be appreciated that the teachings and concepts provided herein are applicable to multifunction products employing color electrophotographic imaging.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for heating a fuser heater of a fuser assembly for an electrophotographic device, the method comprising:

initiating a preheating operation for preheating the fuser heater;

following a temperature of the fuser heater reaching a first predetermined temperature during the preheat operation, calculating, by the electrophotographic device, heater power based on a current temperature of the fuser heater and upon a second predetermined temperature;

calculating, by the electrophotographic device, a current line voltage of a power supply line powering the electrophotographic device;

determining, by the electrophotographic device, a maximum heater power based upon the calculated current line voltage;

comparing, by the electrophotographic device, the calculated heater power to the determined maximum heater power; and, powering the fuser heater at a heating power equal to a lesser of the calculated heater power and the determined maximum heater power to heat the fuser heater from the first predetermined temperature to a second predetermined temperature.

2. The method of claim 1, further comprising, during the preheating operation, calculating, by the electrophotographic device, a heating rate of the fuser heater;

determining, by the electrophotographic device, whether the calculated heating rate exceeds a predetermined heating rate threshold; and, reducing, by the electrophotographic device, the heating power of the fuser heater upon a determination that the calculated heating rate exceeds the predetermined heating rate threshold.

3. The method of claim 2, wherein reducing the heating power comprises reducing the heating power by a percentage between about 50% and about 90%.

4. The method of claim 2, wherein the predetermined heating rate threshold is between about 40° C. per second and about 60° C. per second.

5. The method of claim 2, wherein reducing the heating power comprises reducing the heating power according to the following equation:

$$\text{reduced heating power} = \text{current heating power} - k^* (\text{calculated heating rate} - \text{predetermined heating rate threshold})$$

where "reduced heating power" corresponds to the reduced heating power level of the fuser heater, and k is a constant value between 1 and 5.

6. The method of claim 1, wherein the fuser heater comprises a first heater trace and a second heater trace, and the method further comprises, controlling heating of the first heater trace and the second heater trace of the fuser heater such that the first heater trace is deactivated or activated at no greater than ⅓ of maximum power and the second heater trace is activated at maximum or near maximum power during heating the fuser heater from an initial temperature to the first predetermined temperature.

7. The method of claim 1, wherein the first predetermined temperature is a standby temperature of the fuser heater and the second predetermined temperature is a fusing temperature of the fuser heater.

8. The method of claim 7, further comprising, prior to the temperature of the fuser heater reaching the standby temperature, powering, by the electrophotographic device, the fuser heater using open-loop power control to heat the fuser heater to the standby temperature.

9. The method of claim 8, wherein powering the fuser heater using open-loop power control includes, measuring a warm-up time for the fuser heater;

comparing the measured warm-up time to a predetermined warm-up time threshold stored in a memory of the electrophotographic device; and, if the measured warm-up time is shorter than the predetermined warm-up time threshold, ceasing powering the fuser heater member.

10. The method of claim 1, wherein the electrophotographic device comprises a memory having stored therein a table containing, for each operable line voltage for the electrophotographic device, a corresponding maximum heater power value, and determining the maximum heater power comprises retrieving the maximum heater power value from the table corresponding to the calculated line voltage.

11. The method of claim 1, wherein the fuser heater comprises a first heater trace and a second heater trace, and powering the fuser heater comprises independently controlling the first heater trace and the second heater trace of the fuser heater such that a total power of the first heater trace and the second heater trace is equal to a lesser of the calculated heater power and the predetermined maximum heater power to heat the fuser heater from the first predetermined temperature to the second predetermined temperature.

12. An imaging device, comprising:

a photoconductive member;

a developer unit for developing a toner image on the photoconductive member;

at least one toner transfer area for transferring the toner image to a sheet of media as the sheet of media passes through the toner transfer area in a media feed direction along a media feed path of the imaging device;

a fuser assembly positioned downstream of the at least one toner transfer area in the media feed direction for fusing transferred toner to the sheet of media, the fuser assembly including a fuser heater member having a substrate and one or more heater traces formed on the substrate;

a power supply circuit coupled to the fuser assembly for supplying power thereto; and a controller coupled to the power supply circuit and the fuser assembly for controlling an amount of heat generated by the one or more heater traces of the fuser heater member, and memory coupled to the controller, the controller configured to execute instructions stored in the memory for:

initiating a preheating operation for preheating the fuser heater member;

following a temperature of the fuser heater member reaching a first predetermined temperature during the preheat operation, calculating heater power based on a current temperature of the fuser heater member and upon a predetermined target temperature;

calculating a current line voltage of a power supply line powering the electrophotographic device;

determining a maximum heater power based upon the calculated current line voltage;

comparing the calculated heater power to the determined maximum heater power; and powering the fuser heater member at a heating power corresponding to a lesser of the calculated heater power and the determined maximum heater power to heat the fuser heater member from a first predetermined temperature to a second predetermined temperature.

13. The imaging device of claim 12, wherein the one or more heater traces includes a first heater trace and a second heater trace, and wherein the controller is further configured to execute instructions stored in the memory for controlling the first heater trace and the second heater trace of the fuser heater member such that the first heater trace is deactivated or activated at no greater than ⅓ of maximum power and the second heater trace is activated at maximum or near maximum power during heating the fuser heater member from an initial temperature to the first predetermined temperature.

14. The imaging device of claim 13, wherein the instructions stored in the memory for powering the fuser heater member comprises instructions for independently controlling the first heater trace and the second heater trace of the fuser heater such that a total power of the first heater trace and the second heater trace is equal to a lesser of the calculated heater power and the maximum heater power to heat the fuser heater member from the first predetermined temperature to the second predetermined temperature.

15. The imaging device of claim 12, wherein the controller is further configured to execute instructions stored in the memory for calculating a heating rate of the fuser heater member during the preheating operation; determining whether the calculated heating rate exceeds a predetermined heating rate threshold; and, reducing the heating power of the fuser heater member upon a determination that the calculated heating rate exceeds the predetermined heating rate threshold.

16. The imaging device of claim 15, wherein the controller reduces the heating power of the fuser heater member by an amount between about 50% and about 90%.

17. The imaging device of claim 15, wherein the predetermined heating rate threshold is between about 40° C. per second and about 60° C. per second.

18. The imaging device of claim 12, wherein the first predetermined temperature is a standby temperature of the fuser heater member and the second predetermined temperature is a fusing temperature of the fuser heater member.

19. The imaging device of claim 18, wherein the controller is further configured to execute instructions stored in the memory for powering the fuser heater member using an open-loop power control prior to the temperature of the fuser heater member reaching the standby temperature.

20. The imaging device of claim 12, wherein the controller is further configured to execute instructions stored in the memory for:

prior to the fuser heater member reaching the first predetermined temperature, calculating a warm-up time for the one or more resistance traces to reach a third predetermined temperature from a fourth predetermined temperature less than the third predetermined temperature;

comparing the warm-up time for the one or more resistance traces to a predetermined warm-up time threshold stored in the memory; and, if the warm-up time for the one or more resistance traces is greater than the predetermined warm-up time threshold, uncoupling the power supply circuit to the fuser heater member to cut off power thereto.

* * * * *